US008618737B2

(12) United States Patent
Welten

(10) Patent No.: US 8,618,737 B2
(45) Date of Patent: Dec. 31, 2013

(54) LED ASSEMBLY, LED FIXTURE, CONTROL METHOD AND SOFTWARE PROGRAM

(75) Inventor: Petrus Johannes Maria Welten, Oss (NL)

(73) Assignee: Eldolab Holding B.V., Eindhoven (NL)

( * ) Notice: Subject to any disclaimer, the term of this patent is extended or adjusted under 35 U.S.C. 154(b) by 445 days.

(21) Appl. No.: 12/933,260

(22) PCT Filed: Mar. 12, 2009

(86) PCT No.: PCT/NL2009/000061
§ 371 (c)(1),
(2), (4) Date: Dec. 8, 2010

(87) PCT Pub. No.: WO2009/116854
PCT Pub. Date: Sep. 24, 2009

(65) Prior Publication Data

US 2011/0084615 A1 Apr. 14, 2011

Related U.S. Application Data

(60) Provisional application No. 61/037,176, filed on Mar. 17, 2008.

(51) Int. Cl.
*H05B 41/36* (2006.01)
*G05F 1/00* (2006.01)

(52) U.S. Cl.
USPC ..... 315/153; 315/291

(58) Field of Classification Search
USPC ..... 315/149, 224, 152–154, 291, 307, 312, 315/308; 362/3–5, 613, 800, 642
See application file for complete search history.

(56) References Cited

U.S. PATENT DOCUMENTS

| | | | | |
|---|---|---|---|---|
| 6,512,604 | B1 * | 1/2003 | Machida et al. | 358/513 |
| 6,753,661 | B2 * | 6/2004 | Muthu et al. | 315/307 |
| 7,510,300 | B2 * | 3/2009 | Iwauchi et al. | 362/231 |
| 2007/0046485 | A1 * | 3/2007 | Grootes et al. | 340/815.45 |
| 2007/0145915 | A1 | 6/2007 | Roberge et al. | |
| 2007/0152909 | A1 * | 7/2007 | Fukuda et al. | 345/46 |
| 2008/0191642 | A1 * | 8/2008 | Slot et al. | 315/295 |

FOREIGN PATENT DOCUMENTS

| | | |
|---|---|---|
| EP | 1 482 770 Al | 12/2004 |
| WO | WO 2006/107199 A2 | 10/2006 |

* cited by examiner

*Primary Examiner* — Minh D A
(74) *Attorney, Agent, or Firm* — Browdy and Neimark, PLLC

(57) ABSTRACT

A plurality of LEDs arranged in groups, each group comprising at least one LED, a control circuit for driving the LEDs, the control circuit comprising a sensing device for sensing an operative parameter of the LEDs. The control circuit is arranged to: a) operate at least one group of the LEDs: b) sense by the sensing device a value of the operative parameter of the at least one group; c) repeat a) and b) for at least a different one of the groups; d) assign to each of the groups of LEDs a value of the operative parameter from the sensed operative parameter values; and e) control the driving of the groups of LEDs from the assigned operative parameter values.

11 Claims, 5 Drawing Sheets

LED ASSEMBLY, LED FIXTURE, CONTROL METHOD AND SOFTWARE PROGRAM

BACKGROUND

The invention relates to an LED assembly, a LED fixture, a method for controlling an LED assembly, and to a software program comprising program instructions to, when loaded into a processing device of an LED assembly control circuit, perform such method.

In the past years, application of LEDs for lighting purposes are seen more and more frequently. In such applications, use may be made of LEDs having a same colour, however frequently use is made of groups of LEDs each having a different characteristic, e.g. a different colour. It is for example possible that use is made of red, green and blue LEDs, a synchronous or pulsed operation of the differently coloured LEDs may thereby provide a desired colour, such as white, a whitish colour, or any other desired colour which can be made by e.g. combining two or more of the LEDs. In order to operate the LEDs, a variety of driving circuits and control circuits has been proposed. Thereby, a characteristic of the group of LEDs may be measured, such as a light output, a forward voltage, an LED forward current, etc. As however a plurality of groups of LEDs may be applied, such sensing would be required to be provided for each of the groups, which necessarily increases hardware costs and complexity. As an example, in case that light output is measured, separate light sensors would be required for each of the groups (e.g. by applying an optic coupler which directs a percentage of the light generated by each of the groups to a respective light sensor). Similarly, sensing any other parameter (such as LED forward voltage, LED temperature, LED forward current, etc), sensing circuits are applied for each of the groups.

SUMMARY OF THE INVENTION

The invention intends to provide a simplified control of the LED groups in the LED assembly.

Thereto, the LED assembly according to an aspect of the invention comprises:

a plurality of LEDs arranged in groups, each group comprising at least one LED, a control circuit for driving the LEDs, the control circuit comprising a sensing device for sensing an operative parameter of the LEDs, the control circuit being arranged to:

a) operate at least one group of the LEDs:

b) sense by the sensing device a value of the operative parameter of the at least one group;

c) repeat a) and b) for at least a different one of the groups;

d) assign to each of the groups of LEDs a value of the operative parameter from the sensed operative parameter values; and e) control the driving of the groups of LEDs from the assigned operative parameter values.

According to the invention, at chosen times at least one group is operated, the operative parameter, i.e. the value of the total operative parameter of the operated LEDs, is sensed by the sensing device, which provides the control circuit with a plurality of total operative parameters of a respective group and/or combination of groups operated simultaneously. From these data, the control circuit now derives a value of the operative parameter that would belong to each of the groups of LEDs. This parameter is then applied for controlling each of the groups of LEDs by the control circuit.

The above may be easily demonstrated by an example. Suppose that a group of blue LEDs, red LEDs and green LEDs is provided, e.g. a group comprising at least one blue LED, a group comprising at least one red LED and a group comprising at least one green LED. The operative parameter to be determined may for example be a total light output. A single light sensor may then provided according to the invention for determining de operative parameter. Firstly, the groups comprising the red and blue LEDs are operated simultaneously and total light output is measured. Then, the groups comprising the blue and green LEDs are operated simultaneously and total light output measured. Finally, the groups comprising the red and green LEDs are operated simultaneously and total light output measured. This cycle may be repeated. From the total light output of red and blue, red and green as well as blue and green, a value of the light output of red, blue and green may be calculated, as the above 3 measurements provide 3 equations with 3 unknowns. Having calculated the output of red, green and blue, the respective LED groups may be controlled so as to provide a desired light output value of each of the groups.

Note that, in the example, two groups are operated at the same time and the operative parameter (i.e. the light output) is determined for two groups at the same time. Although such an approach requires a computational effort to determine the individual contributions of the plurality of groups of LEDs, such an approach provides, as explained further below, an advantage.

From the above example, it can be easily understood that the assembly according to the invention requires a single sensing device only in order to measure the operative parameter of each of a plurality of groups. A single sensor will be simpler to integrate in a fixture than multiple sensors and will save on the cost and volume for the sensor. A single sensor will save even more volume as it does not need an optical mixing path, only a one-time calibration of each LED to sensor transfer function. This facilitates substantially the integration of driver and/or sensor with the LED groups into a LED assembly and fixture.

In an embodiment, the present invention essentially enables the determination of an operative parameter (e.g. a light output, a forward voltage, etc . . . ) without disruption of the normal operation of the lighting application. In order to determine an operative parameter of an LED assembly comprising a plurality of LEDs arranged in groups, each group comprising at least one LED, it is proposed in literature to determine a contribution to the operative parameter of a given LED or LED group by momentarily disabling all LEDs or LED groups except the given LED or LED group, repeating the process for each LED or LED group and adding the contributions of the different LEDs or LED groups. Instead, in an embodiment of the present invention, at least two groups of LEDs are operated at the same time. In a preferred embodiment, only one LED or LED group is disabled at the same time to determine the required operative parameter. As will be illustrated, such an approach hardly affects the normal operation of the lighting application. When a measurement instance would e.g. take 10 μs, on a duty-cycle interval of e.g. 8 ms, performing 3 measurements for determining an operative parameter of 3 LED groups would each only take away only about 0.1% of the light output of each group. Applying the present invention may thus have a reduced impact on the duty. The reduced impact on the duty-cycle may have as an additional advantage a reduced contribution to visual or non-visual (causing nausea) flicker. In addition, the reduced measurement duty-interval may also allow a higher frequency feedback loop(s) which allow a more strict and stable mixed light output. When at least two groups of LEDs are simultaneously operated each measurement, instance, a total operative parameter thereof is sensed. Thereby, higher intensities may be achieved, as groups of LEDs may be operated simultaneously, while at the same time maintaining the advantages of the invention, as sensing the total operative parameter of the simultaneously operated LEDs requires a single sensing device only. When the groups of LEDs are operated at a duty cycle less than 100%, the normal operation of the lighting application is not affected at all by the measurement since a measurement scheme of the measurement instances can be devised results in the operative parameter to be determined without affecting the desired duty cycles.

In addition to the savings in complexity, volume, costs etc., which may be provided by the application of a single sensing device, further advantages may be achieved. As an example, a provision of a plurality of light sensors and corresponding guides in order to guide light towards the respective sensors, would exhibit some degree of cross talk which would result in light from e.g. the blue group to arrive at the sensor of the red group, etc, which would adversely effect an accuracy of measurements, thereby possibly adversely affecting an accuracy of controlling an output of the LEDs.

Therefore, in a preferred embodiment of the invention, the control circuit is arranged to operate the groups of LEDs, by a) activating or de-activating a first one of the groups;

b) waiting during a predetermined wait time period; and c) repeating a) and b) for a second one of the groups.

Thereby, moments in time are obtained during which a particular one of the groups is activated, or during which two or more of the groups are activated, which enables to measure by means of the sensing device the operative parameter for that group or for those groups together. In particular, by de-activating a first one of the groups, waiting and then activating another one of the groups, a time period (the waiting time period) is created during which the first one of the groups is deactivated, which allows to measure the operative parameter of one or more of the other ones that remain activated during the waiting time period. By repeating the above de-activating, waiting and activating for a remainder of the groups, time periods are obtained (the respective waiting time periods), during which measurements can be performed by the sensing device for the group or groups that remain active during that waiting time period. Hence, the deactivating and activating may provide for time periods which different ones of the groups or different combinations of the groups are activated, thus providing a method and algorithm of activating the groups of LEDs which is compatible with the control according to the invention.

The next example demonstrates a further advantage. Suppose that, for example 3 groups of white LEDs are provided in a fixture, in which each white LED radiates light of a different color temperature. Suppose further that these white LEDs are all built using identical base LEDs of for example (but not limited to) a blue-ish color, covered with phosphor of for example (but not limited to) a yellowish color, to arrive at for example (but not limited to) white light of different color temperatures depending for instance on dimensioning and type of the phosphor. The operative parameter sensed may for example be a total light output not from the LEDs as a whole, but from the underlying base LEDs, by providing a light path from these base LEDs to the sensor. A single light sensor, only sensitive to the blue-ish light from the base LEDs, is then provided according to the invention. Firstly, the first and second group of LEDs are operated simultaneously and total light output measured. Then, second and third group of LEDs are operated simultaneously and total light output measured. Finally, first and third group of LEDs are operated simultaneously and total light output measured. This cycle may be repeated. From the total light output of first and second, first and third as well as second and third groups, a value of the light output of the first, second and third group may be calculated, as the above 3 measurements provide 3 equations with 3 unknowns. Using the phosphor transfer function the value of the total light output per group can then be calculated. Having calculated said total light output of the first, second and third groups of LEDs, these respective LED groups may be controlled so as to provide a desired light output value of each of the groups, thus controlling the total color temperature of the fixture.

From the above example, it can be understood that, in an embodiment, the LED assembly according to the invention requires a narrow band (monochrome) single sensing device only in order to measure the operative parameter of each of a plurality of groups of white LEDs of same or different color temperature, of which the white LEDs are constructed using a mono-color base LED. A monochrome sensor is, in general, less expensive than a broad spectrum sensor and simplifies the system while increasing reliability.

Providing a LED fixture having a plurality of substantially identical base LEDs (e.g. monochrome LEDs) with a single sensor arranged to receive part of the radiated light by the base LEDs rather than sensing the light output of the LEDs as a whole (i.e. when the radiated light has been transformed by a phosphor coating) provides the advantage that the sensor can be positioned closer to the LEDs thereby improving the resolution of the measurement.

Therefore, according to an aspect of the invention, there is provided an LED fixture comprising a plurality of LEDs, in use having substantially the same monochrome light output, and a cover provided with a coating or coatings of phosphor or phosphorous materials arranged to receive at least part of the monochrome light output and a light sensor arranged to receive part of the monochrome light output of the plurality of LEDs. As an example, the light sensor can be provided below the cover to detect the light emitted from the different LEDs. By providing the light sensor below the cover, the visual appearance of the LED fixture is improved as the light sensor and possible wiring of the sensor are arranged below a cover of the LED fixture. In an embodiment, the cover of the LED fixture according to the invention is provided with different phosphorous coatings whereby each coating is arranged to substantially receive the light output of a subset (e.g. one) of the plurality of LEDs. Each coating can e.g. result in a different colour output of the LED fixture. By operating the different subsets at different duty cycles, the colour output of the LED fixture can be altered.

In addition, in case the LEDs all have the same monochrome light output, the light sensor can be a monochrome sensor to detect the radiated light by the different LEDs. Such a sensor is likely to be less expensive that an optical sensor having a broad spectral range. In order to establish the light output of the light assembly, a calibration can be done providing the relationship between the light generated by each LED as perceived by the sensor and the light output as perceived outside the LED assembly, i.e. when the light has passed the phosphorous cover. In order to compensate for aging (e.g. deterioration of the phosphorous coating), such calibration can be repeated over time. In order to determine the relationship between the light generated by each LED as perceived by the sensor and the light output as perceived outside the LED assembly, i.e. when the light has passed the phosphorous cover, an additional sensor can be provided for sensing the light output as perceived outside the LED assembly. As an alternative or in addition, the calibration can be performed during the manufacturing process of the LED fixture.

The LED fixture according to the invention may advantageously be applied in an LED assembly according to the invention.

In addition to mixing different white-shades using a multitude of single blue colour LEDs as a base, the same principle is valid with another common LED base colour (other than blue) which can then also mix other colours using other than white phosphors, e.g. RGBW or RGBA phosphors (allowing to mix a huge spectrum of colours which can then have a single monochrome sensor feedback mechanism).

Although the above illustrates different aspects of the invention whereby the sensing device comprises a light sensor, many variations and arrangements are possible.

When the sensing device of the LED assembly e.g. comprises a voltage sensing circuit, it is for example possible to measure an LED forward voltage. The LED forward voltage may be applied as a measure of the operating temperature an LED is operating at. The operating temperature may in turn have an effect on the amount of light that is radiated at a certain current. Knowing the forward voltage may enable in part the compensation of this effect. The compensation may make use of a given dependency between the forward voltage and the amount of radiated light and counteract that dependency. Furthermore, given a known relation between forward voltage change and temperature change, temperature information of the LEDs of the group may be derived voltage measurements. Measurement of the forward voltage may further be applied to detect the number of series connected LEDs per group. Still further, voltage measurement may be applied to monitor rise and fall time in case of switching on and/or off of the groups, which may be taken into account in pulsed modulation schemes (such as pulse width modulation, pulse frequency modulation, etc.). Also, changes in rise and fall times between groups having different numbers of LEDs may be taken into account.

Therefore, in an embodiment, the LED assembly according to the present invention is arranged to determine the LED forward voltage of the different LED groups of the assembly. Similar to the sensing of a light output parameter, it may be advantageous to determine the forward voltage over more than one group at the same time. Such an approach can e.g. be applied in an LED assembly where the plurality of LED groups are arranged in series. An example of such an assembly is described in more detail below. As the forward voltage of an LED group may depend both on current or power consumption of the LED group and the operating temperature of the LED group, assessing the operating temperature of the LED groups based on the forward voltage values of the different LED groups may be insufficient to accurately determine the operating temperature. A more accurate determination of the temperature can be obtained by combining the forward voltage measurements with a current measurement; Often, in an LED assembly, a current measurement is available (e.g. as a voltage drop over a resistor in series with the plurality of LED groups) which allows a determination of the current provided to the LED groups when the forward voltage is determined. As such, the temperature of the different LED groups can be more accurately established based on the determined forward voltage of the LED groups and the current provided to the LED groups.

Yet another possibility of an operational parameter as can be determined by an LED assembly according to the invention is measurement of an LED forward current: Knowing the LED forward current may be required to control the value of the current (e.g. by controlling an output current of a power supply (such as a current source or a voltage source which supplies the operating current to the LED groups). Furthermore, the forward current measurement may be applied to detect faulty LED groups, which may be deactivated. Still further, a combination of forward voltage and current may be applied to determine LED group dissipation, which may be applied in a thermal control scheme or thermal compensation scheme. According to a further example, an LED temperature may be measured. Temperature of the LED may have an influence on the amount of radiated light at a certain current. Knowing the temperature one may compensate.

As a still further example, a brightness (also referred to as 'light output') may be measured, as has already been illustrated in an above example, to thereby e.g. enable feedback control of the light output. Numerous other parameters may be measured, such as for example a color value, brightness in certain color bands, etc depending on the requirements on the light output and characteristics of the LEDs and driving electronics applied.

The groups of LEDs may comprise any group, e.g. groups of LEDs having a same colour, groups of LEDs having any other same or similar characteristic, such as having a same light output versus temperature, a same voltage current characteristic, etc. Also, groups of arbitrary LEDs may be provided.

The control circuit may comprise any type of control circuit, including e.g. analog control electronics, digital control electronics, such as a micro controller, micro processor, or any other suitable control device such as a Field Programmable Gate Array (FPGA), a programmable logic device (PLD), discrete logic electronics etc.

The sensing device may measure a total operative parameter of the simultaneously operated LEDs (e.g. a total current, total forward voltage of e.g. series connected LEDs, etc) to thereby achieve a simple and straight forward sensing device. Other arrangements are however possible too, it is for example possible that (e.g. due to a sensing characteristic of the sensing device), a calibration curve is applied. For example, in case of a light sensor having a colour dependent output, and applying groups of LEDs each having a different colour, a calibration curve may be applied to the operative parameter measured in order to derive the values of the separate groups there from.

In a preferred embodiment, the groups of LEDs are connected in series, the assembly comprises a current source to generate an LED operating current and a respective switch parallel to each of the groups, the control circuit being arranged to operate each group by driving the respective switch to a substantially non conductive state so that the operating current flows through the respective group, and to deactivate a respective group by driving the respective switch to a substantially conductive state to bypass the operating current via the respective switch. This circuit arrangement may provide for a suitable, compact, circuit topology for the above described, activating or de-activating, waiting and repeating.

Many examples of the operative parameter may be provided. As an example, the operative parameter may comprise an LED forward voltage, the sensing device thereby comprising a forward voltage sensing circuit. The forward voltage of the LEDs provides for information concerning it's electric power consumption (which is determined by the forward voltage times the operating current of the respective LED), thereby providing information concerning it's heat dissipation as well as it's light output, however the forward voltage may also provide an indirect information concerning the operating temperature of the LEDs of the group.

The operative parameter may comprise an illumination, the sensing device thereby comprising a light sensor. Thereby, a light output of the LEDs may be measured. In case of groups of LEDs operating at different wave lengths (e.g. irradiating a different colour), use may be made of a light sensor which is able to detect each of the wave lengths having a substantially same sensitivity. In case that use is made of a sensor which exhibits a monochrome character to a certain degree, e.g. a gradually changing sensitivity for the different wave lengths of the groups of LEDs, a calibration curve may be applied to correct for the different sensitivity of the sensor at the different wave lengths of the LEDs of the various groups.

In a further embodiment, the operative parameter comprises an LED operating current, the sensing device comprising a current sensing circuit. Measurement of the LED operating current may provide for a relatively simple means to obtain an indication about LED light output intensity, as commonly an LED exhibits a direct relation between it's operating current and it's output illumination.

Of course many other examples of operative parameters are possible as outlined earlier. Also, combinations of the above described operative parameters are possible: it is for example possible to measure a forward voltage as well as a light output, thereby employing a total forward voltage sensing circuit as well as a light output measurement device (e.g. a photo diode). Thereby, accurate yet simple control may be provided, as a variety of parameters may be measured, while at the same time keeping relatively simple hardware as only a single light sensor, a single forward voltage detecting circuit etc is required.

In a further, advantageous embodiment, the control circuit is arranged to assign to the groups of LEDs operating cycle parts of an operating cycle of the LEDs, the operating cycle parts during each of which at least one group of the LEDs is operated, the total value of the operative parameter being sensed in each of the cycle parts, the operating cycle parts being assigned to the groups such that values of the operative parameter of each of the groups can be calculated from the measurements of the total values of the operative parameter of the groups activated in the cycle parts. Thereby, groups of LEDs may for example be operated simultaneously, which e.g. allows achieving a desired illumination characteristic, while the combinations are chosen such that the operative parameter of each of the groups of LEDs can be determined there from. As an example, having 3 groups, operation of groups 1 and 2 simultaneously provides a total operative parameter of groups 1 and 2, operation of groups 2 and 3 simultaneously the total operative parameter of groups 2 and 3, and operation of groups 1 and 3 simultaneously the total operative parameter of groups 1 and 3. Now, 3 measurement results are obtained from which the 3 unknown values, i.e. the operative parameters of each of the groups, can be calculated by e.g. a processing device of the control circuit.

In an embodiment, the LED assembly comprises a current source to generate an LED operating current and a respective switch parallel to each of the LED groups. In such an arrangement, the control circuit can be arranged to operate each group by driving the respective switch to a substantially non conductive state so that the operating current flows through the respective group, and to deactivate a respective group by driving the respective switch to a substantially conductive state to bypass the operating current via the respective switch.

As an example, a current source as can be applied in an LED assembly according to the invention includes but is not limited to a power converter such as a Buck, Boost, Buck-Boost, Sepcic, Cuk or resonant converter. In general, the current source for the LED assembly can range from a simple resistor, a linear regulator to any of the converters mentioned.

The invention also comprises a method for controlling an LED assembly comprising a plurality of LEDs arranged in groups, each group comprising at least one LED, the method comprising:

a) operating at least one group of the LEDs:
b) sensing by the sensing device a value of the operative parameter of the at least one group;
c) repeating a) and b) for at least a different one of the groups;
d) assigning to each of the groups of LEDs a value of the operative parameter from the sensed operative parameter values; and
e) controlling the driving of the groups of LEDs from the assigned operative parameter values.

With the method according to the invention, the same or similar advantages can be achieved as with the LED assembly according to the invention. Also, same or similar preferred embodiments may be provided, providing same of similar effects as outlined above with respect to the LED assembly according to the invention.

A further aspect of the invention relates to the use of a sensor (e.g. an opto-sensor) as a current feedback. The current source that powers the LED groups is arranged to provide, in order to establish a certain output characteristic, a certain current to the plurality of LED groups of the LED assembly. The current source is able to provide this current at a desired value by a feedback signal representing the amplitude of the current. In order to establish the required current, the current source in general comprises a switcher (e.g. a MOSFET) operating at a high frequency, e.g. 500 kHz. In known LED based applications, the current as provided to the LEDs of the LED assembly is sensed by providing a resistor arranged to receive the current through the LED assembly. The resistor can e.g. be series connected with the LEDs of the LED assembly. A voltage drop over the resistor can be applied as a measure for the instantaneous current through the LEDs of the LED assembly and thus used as a feedback signal to the current source.

The present invention provides an alternative approach by establishing the feedback signal in a different manner. In case the LED assembly comprises an optical sensor for determining a lighting flux of a LED group of the plurality of LED groups, a measured lighting flux can be applied as an indication for the current through the LED group.

The optical sensor can e.g. instantaneously measure the lighting flux of a single LED or LED group or can measure the lighting flux of more than one group at the same time. Using calibration data (e.g. obtained from a factory measurement), the current through the LED assembly can be determined based on the flux measurement.

The optical sensor can either be a monochrome sensor or a sensor covering a broad frequency spectrum. In the first case, and in case the plurality of LED groups are series connected, the output of only one LED or LED group of the LED assembly needs to be taken into account for determining the current provided to the LED assembly.

The optical sensor can, as mentioned, be arranged to determine the lighting flux instantaneously. By doing so, a possible duty cycle of the LED or LED group measured need not be taken into account. In addition, an instantaneous flux measurement, rather than an average flux measurement is preferred as it avoids the integration of the flux measurement. In an embodiment, the flux measurement is synchronised with the operating of the LED or LED group that is measured. Preferably, the control unit of the LED assembly is used to synchronise the flux measurement with the operation of the switch that controls the LED or LED groups that is monitored.

As an alternative, a current provided to an LED group can be determined based on an (instantaneous) forward voltage measurement over the LED group. As the relationship between the forward voltage and the current is dependent on the operating temperature, a temperature sensor can be provided as well to establish the temperature of the LED or LED group of which the forward voltage is measured or determined.

Based on the either the measured flux or forward voltage (optionally in combination with a temperature measurement) a feedback signal representative of the current provided to an LED group can be established. Such a signal can e.g. be provided to the control unit of LED assembly according to the invention to establish a control signal to the current source arranged to power the LED assembly according to the invention. Based on the control signal, a switching element of the current source can be operated to establish a certain current setpoint. By modifying an amplification of said control signal, the current source can be made to operate at different current set point without changing the actual measurement used for providing the feedback signal. This can be illustrated by the following example. Assuming that a measured forward voltage is applied (optionally in combination with a temperature measurement) to determine an actual current value Iact. The measured forward voltage can thus be applied to the control unit as a feedback signal in order to determine a control signal representing the actual current value Iact. The control signal can e.g. be provided directly to the current source as a feedback. In case the determined current value corresponds to the required current value Ireq, the current source will maintain its operation. If, instead of providing a control signal representing the actual current value Iact as feedback to the current source, a signal, Iact*K is provided as a feedback, the current source will adjust its operating conditions until a current Ireq=Iact/K is provided. By e.g. reducing the determined current value Iact by a factor of two, a feedback control signal based on this reduced value will be interpreted by the current source as if the actual current value is only half of the required current.

By generating a current feedback based on either a forward voltage measurement or a flux measurement, no separate means for current measurement (e.g. a resistor connected in series with an LED group) are required. The forward voltage measurement or flux (or illumination) measurement as received by the control circuit of the LED assembly according to the invention can thus be applied by the control circuit to derive a current feedback signal.

As a consequence, the volume requirements and dissipation of such a resistor can be avoided.

It is however worth nothing that the outlined principle of scaling a feedback signal in order to adjust a current setpoint may also be applied in case the feedback signal is determined from a voltage measurement over a resistor in series with an LED group of the LED assembly.

The invention may also be provided in a form of a software program comprising program instructions to, when loaded into a processing device of an LED assembly circuit, perform the method according to the invention. It will be understood that the software program may provide for same or similar effects as the LED assembly and method according to the invention, while same or similar preferred embodiments may be provided, thereby providing same or similar effects and advantages.

Further advantages, embodiments and features of the invention will become clear from the appended drawing and corresponding description, showing non-limiting embodiments in which.

Figure 5:
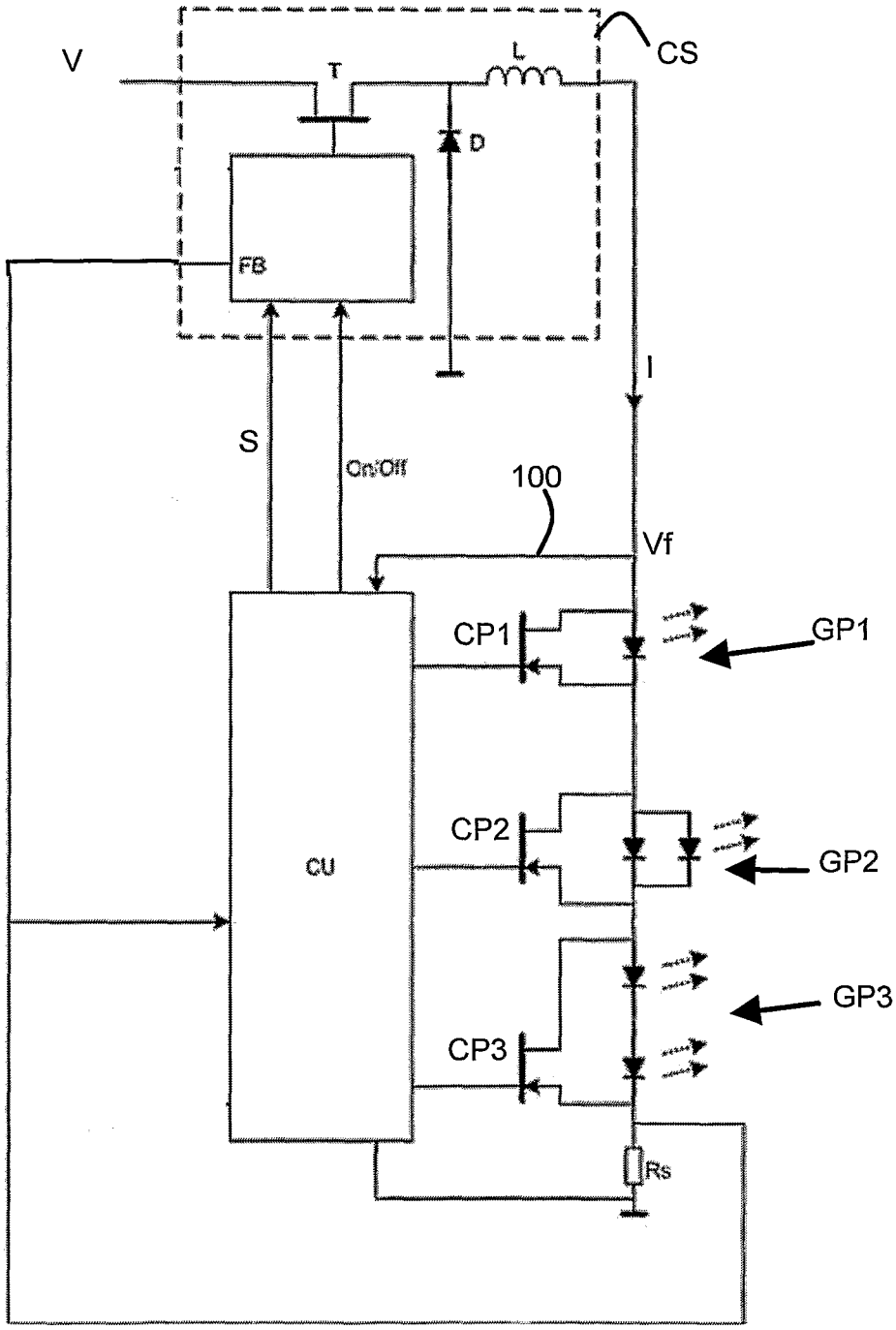

FIG. 5 schematically depicts another LED assembly according to the invention.

Figure 6A:
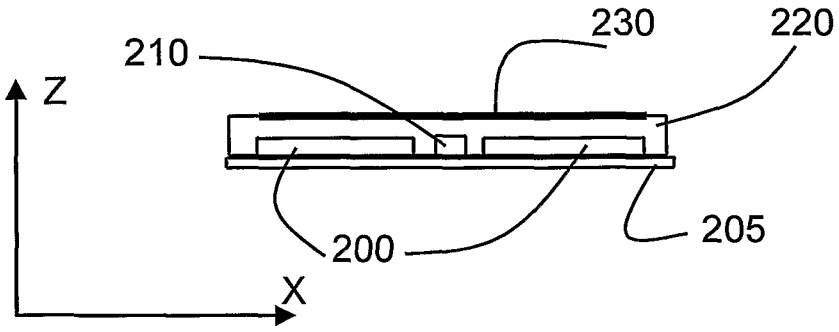
Figure 6B:
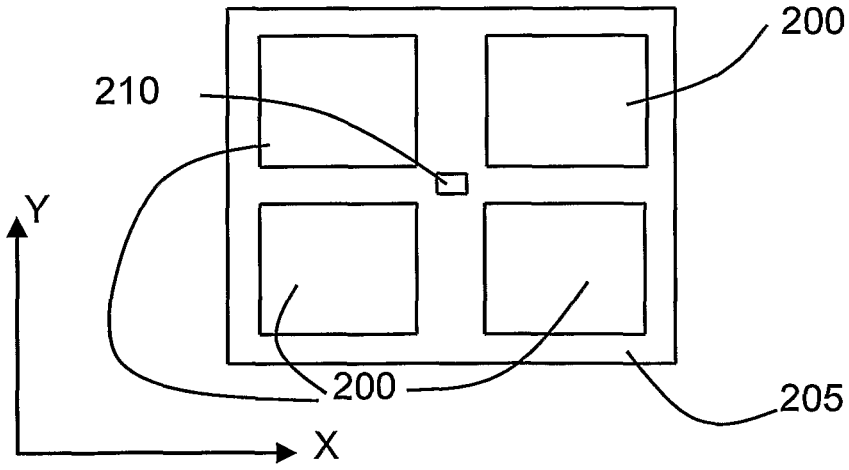

FIGS. 6*a* and 6*b* schematically depict an embodiment of an LED fixture according to the invention.

Figure 1:
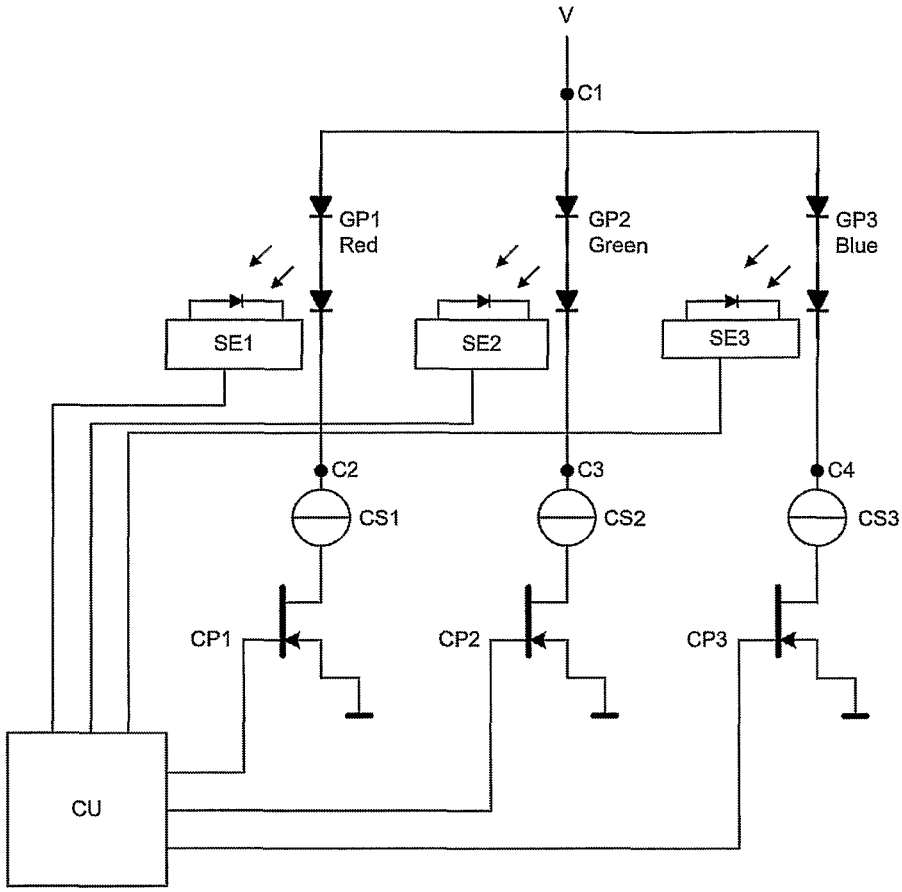
FIG. 1 depicts an LED assembly having a sensing arrangement according to the prior art.

FIG. 1 depicts a configuration according to the prior art, comprising 3 Led groups, namely a Red, Green and Blue one, respectively indicated as GP1, GP2 and GP3, each comprising a series connection of 2 LEDs. Each of the groups is provided with its own current source, namely CS1, CS2 and CS3 respectively, which may each be switched on by a respective switching transistor, namely CP1, CP2 and CP3 respectively. The transistors, current sources and series connected LEDs are connected to a common supply voltage V. A control unit CU is provided to control switching of the transistors CP1, CP2 and CP3 respectively. In this example a light output of each of the LED groups is sensed by a respective sensor, namely SE1 for sensing an output (illumination, brightness) of the red group, SE2 for sensing a light output of the green group and SE3 for sensing an output of the blue group. Each of the sensors is connected to respective readout electronics, comprising e.g. an amplifier, an output signal thereof being provided to the control unit. The (e.g. pulsed) switching on and off of the respective transistors CP1, CP2 and CP3 can now be controlled in response to the light intensity sensed by the respective groups, possibly in combination with other parameters, such as a setpoint signal representing a desired light intensity and/or color scheme.

Figure 2:
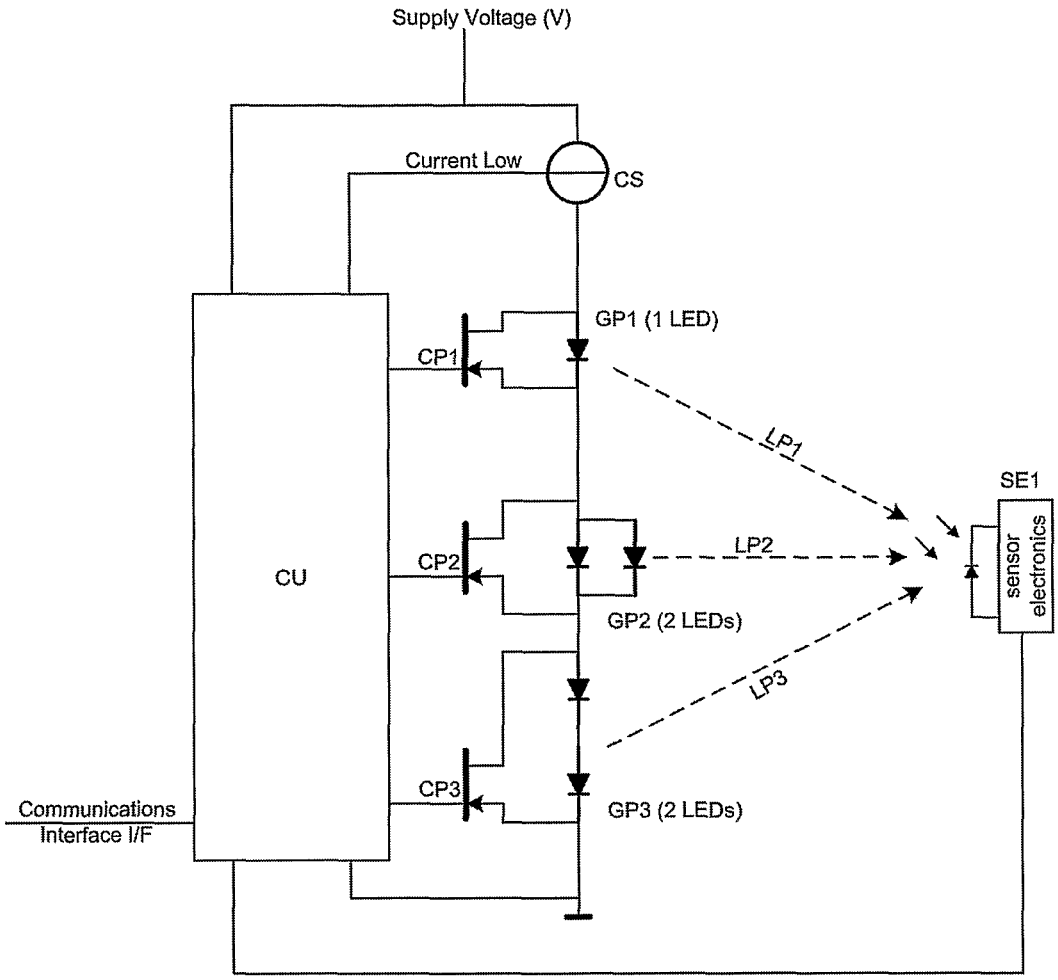
FIG. 2 depicts an LED assembly according to an embodiment of the invention.

FIG. 2 depicts an LED assembly according to an embodiment of the invention, comprising 3 LED groups, a first group, referred to as GP 1, in this example comprising a single LED, a second group, referred to as GP 2, in this example comprising 2 parallel LEDs, and a third group, referred to as GP 3, in this example comprising a series connection of 2 LEDs. Each of the groups is provided with a parallel switching transistor, referred to as CP1, CP2 and CP3 respectively, driven by a control unit, in FIG. 2 referred to as CU. According to an aspect of the invention, a single sensor SE1 is provided, in this example a light sensor such as a photodiode, which is able to receive light from each of the groups of LEDs via respective light paths LP1, LP2 and LP3 respectively. An output of the sensor is amplified by a suitable amplifier, an output thereof being provided to the control unit CU. In this embodiment, a single current source CS is provided which may supply an operating current to all three groups of LEDs. Thereto, a respective group is activated by the control unit CU in that the control unit CU drives the respective transistor to a substantially non conducting state. Conversely, driving the transistors to a conducting state will short circuit the LED group, thereby deactivating it. It is remarked that in this embodiment, the current source CS may be deactivated by the control unit CU. Furthermore, the control unit CU may be provided with a communications interface I/F via which data may be obtained, such as a desired intensity, and/or via which status information may be transferred. A possible operation of the FIG. 2 embodiment will now be described with reference to FIG. 3.

Figure 3:
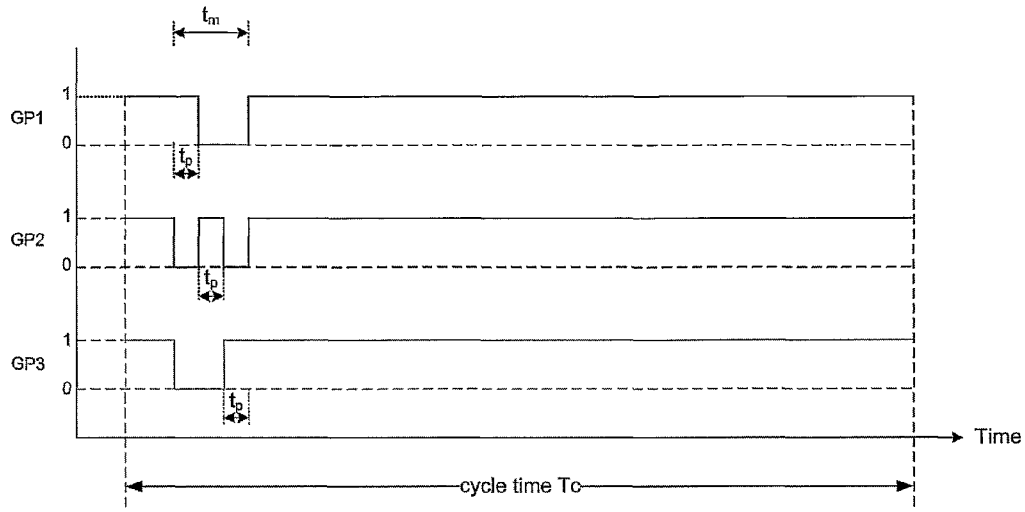
FIG. 3 depicts an embodiment of a timing diagram of driving LED groups of the embodiment according to FIG. 2.

In FIG. 3, a timing diagram is depicted, displaying an operating state of each of the LED groups versus time T, more specifically over a cycle time period Tc. For each of the groups, an active state is depicted by 1, while a deactivated state is depicted by 0. In the cycle time period Tc, a measurement time tm is defined, wherein for each of the groups a time period tp can be found wherein the respective group is activated solely, in other words wherein the remaining groups are deactivated. In these time periods, an output signal measured by the sensor will reflect a measurement value of the respective group. Hence, a single sensor may provide measurement information for each of the groups. The measurement information of each of the groups is applied by the control unit to drive the respective groups, possibly in combination with a desired (set-point) value. The depicted pattern may be repeated during a next cycle time Tc.

Figure 4:
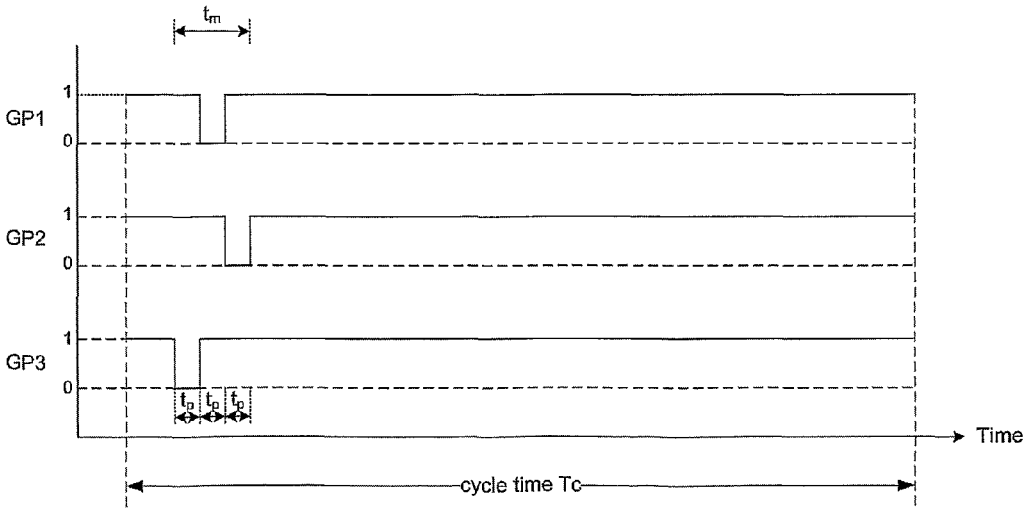
FIG. 4 depicts another embodiment of a timing diagram of driving LED groups of the embodiment according to FIG. 2.

FIG. 4 depicts an alternative timing diagram, wherein in the measurement time tm pairs of 2 groups are operated during respective time periods. The sensed intensity during the respective time periods thereby provides respective sums of intensities of the respective pairs of 2 groups. The intensities of the individual groups can be calculated there from and used by the control unit to drive the respective switching transistors in order to drive the LEDs.

A combination of the FIG. 3 and FIG. 4 embodiments may also be provided: as an example, the operative parameters for each of the groups obtained by the FIG. 4 measurement may be compared to the operative parameters for each of the groups obtained by the FIG. 3 embodiment. If differences are detected, it may be concluded that mutual influence between the groups occurs while measuring combinations of two of more groups, and the control unit may choose to revert to the FIG. 3 algorithm thereby measuring the groups individually by the single sensing device.

The FIG. 3 and FIG. 4 embodiments provide examples wherein a group is activated or deactivated, and after a waiting time another one of the groups is activated or de-activated.

Although in the FIGS. 3 and 4 embodiments, the measurements take place consecutively in a measurement time tm which forms a relatively small part of the cycle time Tc, the measurements may also take place at other parts of the cycle time, e.g. at mutually spaced time intervals In order to drive the LEDs at a desired intensity, any suitable modulation scheme, such as pulse width modulation, pulse frequency modulation, pulse position modulation, etc and/or any other one of the driving algorithms as disclosed in WO2006/107199 may be applied, thereby obtaining moments in time wherein the sensing device may measure an output representative for a single one or a combination of the groups of LEDs.

It will be understood that the groups of LEDs may comprise a single LED, series and/or parallel connections of two or more LEDs, etc Furthermore, it will be understood that the obtained sensor signal and operative parameters derived there from, may be applied in any type of control scheme, such as feed forward control, feedback control, iterative control, etc.

FIG. 5 schematically depicts another LED assembly according to the invention. The LED assembly comprises a plurality of LEDs arranged in groups GP1, GP2 and GP3, each group comprising at least one LED, and a control circuit CU for driving the LEDs. The LED assembly further comprises a current source CS for providing a current I to the plurality of LED groups. The embodiment further comprises a forward voltage sensing circuit 100 for sensing a forward voltage (Vf) over one or more of the LED groups, depending on the operating state of the switches CP1, CP2 and CP3 (e.g. MOSFETs or transistors) provided in parallel to the LED groups. By appropriately operating the switches CP1, CP2 and CP3, the forward voltage over each of the three LED groups can be determined from three forward voltage measurements, as explained above. The lighting application as shown in FIG. 5 further comprises a current source CS for providing a current I to the LED groups. The current source CS as depicted is a so-called Buck converter arranged to convert an input voltage V to a current I using a switching element T (e.g. a MOSFET), an inductance L and a diode D. The current I as provided to the LED groups can be determined from the voltage over resistance Rs, said voltage being provided to the control unit CU. The control unit CU can further be equipped to provide an On/Off signal to the current source CS in order to turn the current source on or turn it down. As mentioned above, the voltage over resistance Rs is applied as a feedback to the control unit CU and to the converter (to the FB-port via the resistance R1). As an alternative to the application of a resistance Rs in series with the LED groups, the forward voltage (optionally combined with a temperature measurement) can be applied as a feedback signal to the control unit CU, whereby the control unit can be arranged to provide, based on the feedback signal, a control signal S to the current source CS, as a feedback on the actual current level I. By doing so, the application of the resistance Rs and thus the occurring losses can be omitted.

FIGS. 6*a* (XZ-view) and 6*b* (XY-view) schematically depict an LED fixture according to the invention, the LED fixture comprising four monochrome LEDs 200, e.g. arranged on a single chip 205 and a sensing device, e.g. a light sensor 210 arranged adjacent the LEDs to receive part of the light emitted by the LEDs. The fixture is further provided with a cover 220 comprising a phosphor or phosphorous material, e.g. as a coating 230 (in general, a material that enables obtaining a frequency shift of a light output received by the material), the cover being arranged to receive light emitted from the LEDs and to emit light having a different frequency or frequency spectrum. The cover can e.g. be provided with different types of materials enabling a frequency shift of a light output received by the material thereby obtaining a LED fixture that enables the generation of different colours. As an example, the cover 220 can be provided with four different types of phosphor or phosphorous materials (e.g. to generate a substantially RED, GREEN, BLUE and WHITE light), each material being arranged to substantially receive a light output from only one of the four LEDs 200, thereby enabling, by operating the different LEDs at different duty cycles, a variable colour light output. The LED fixture according to the invention may advantageously be provided with a monochrome sensor; because the sensor is arranged to receive the light output emitted from the LEDs, the sensor needs to be sensitive only to the frequency of the light emitted by the LEDs. An arrangement of the sensor substantially below the phosphor or phosphorous coating enables the sensor to be positioned close to the LEDs and avoids the sensor blocking light emitted by the coating. The LED fixture according to the invention may advantageously be applied in a LED assembly according to the invention.

It will be apparent to the skilled person that the present invention enables to provide more compact and less expensive LED fixtures and LED assemblies. Due to the reduction of the number of components as applied, an increased reliability may also be achieved. It is submitted that the embodiments of the LED fixture, the LED assembly, the software program and the method for controlling an LED assembly are merely exemplary and that other embodiments may be devised within the scope of the present invention, the scope of the present invention only being limited by the following claims.

The invention claimed is:

1. A light-emitting diode (LED) assembly comprising:

a plurality of LEDs arranged in groups, each group comprising at least one LED, a control circuit for driving the LEDs, the control circuit comprising a sensing device for sensing an operative parameter of the LEDs, said operative parameter comprising a forward voltage;

the control circuit being arranged to:

a) operate at least two of the groups of the LEDs simultaneously with each other;

b) sense by the sensing device a total value of the operative parameter of the at least two groups;

c) repeat a) and b)for at least a different combination of at least two of the groups;

d) determine the operative parameter for each of the at least two groups from the sensed total values of the operative parameter;

e) assign to each of the groups of LEDs a value of the operative parameter from the determined operative parameter values;

f) estimate a temperature of each of the LED groups based on the assigned value of the operative parameter; and g) control the driving of the groups of LEDs from the assigned operative parameter values by using the estimated temperature.

2. The LED assembly according to claim 1, wherein the sensing device is arranged to measure a total operative parameter of simultaneously operated LEDs.

3. The LED assembly according to claim 1, wherein each repetition is performed for a respective subset of at least two of the groups.

4. The LED assembly according to claim 1, wherein the control circuit is arranged to operate the groups of LEDs, by a) activating or de-activating a first one of the groups;

b) waiting during a predetermined wait time period; and c) repeating a) and b) for a second one of the groups.

5. The LED assembly according to claim 1, wherein the groups of LEDs are connected in series, the assembly comprises a current source to generate an LED operating current and a respective switch parallel to each of the groups, the control circuit being arranged to operate each group by driving the respective switch to a substantially non conductive state so that the operating current flows through the respective group, and to deactivate a respective group by driving the respective switch to a substantially conductive state to bypass the operating current via the respective switch.

6. The LED assembly according to claim 5 wherein the current source comprises at least one of a linear regulator or a Buck, Boost, Buck-Boost, Sepcic, Cuk or resonant converter.

7. The LED assembly according to claim 1, wherein the sensing device comprising a forward voltage sensing circuit.

8. The LED assembly according to claim 1, wherein the control circuit is arranged to assign to the groups of LEDs operating cycle parts of an operating cycle of the LEDs, the operating cycle parts during each of which at least one group of the LEDs is operated, the total value of the operative parameter being sensed in each of the cycle parts, the operating cycle parts being assigned to the groups such that values of the operative parameter of each of the groups can be calculated from the measurements of the total values of the operative parameter of the groups activated in the cycle parts.

9. A method for controlling a light-emitting diode (LED) assembly comprising a plurality of LEDs arranged in groups, each group comprising at least one LED, the method comprising:

a) operating at least two of the groups of the LEDs simultaneously with each other:

b) sensing by the sensing device a total value of the operative parameter of the at least two groups;

c) repeating a), b) for at least a different combination of at least two of the groups;

d) determine the operative parameter for each of the at least two groups from the sensed total values of the operative parameter;

e)assigning to each of the groups of LEDs the total value of the operative parameter from the determined operative parameter values;

f) estimate a temperature of each of the LED groups based on the assigned value of the operative parameter; and g) controlling the driving of the groups of LEDs from the assigned operative parameter values by using the estimated temperature.

10. The method according to claim 9 wherein the sensing device is arranged to measure a total operative parameter of simultaneously operated LEDs.

11. A software program stored on a non-transitory computer readable medium, comprising program instructions to, when loaded into a processing device of an LED assembly control circuit, perform the method according to claim 9.

* * * * *

UNITED STATES PATENT AND TRADEMARK OFFICE

CERTIFICATE OF CORRECTION

PATENT NO. : 8,618,737 B2
APPLICATION NO. : 12/933260
DATED : December 31, 2013
INVENTOR(S) : Petrus Johannes Maria Welten It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 528 days.

Signed and Sealed this
Twenty-second Day of September, 2015

Michelle K. Lee

Michelle K. Lee
*Director of the United States Patent and Trademark Office*